US005560232A

United States Patent [19]

Chen

[11] Patent Number: 5,560,232

[45] Date of Patent: Oct. 1, 1996

[54] COMBINATION LOCK HAVING A SHACKLE

[76] Inventor: cheng jung Chen, No. 113, Pyngdeeng Road, Luhgaang Town, Janghuah Shiann, Taiwan

[21] Appl. No.: 423,137

[22] Filed: Apr. 18, 1995

[51] Int. Cl.[6] ..... E05B 37/02

[52] U.S. Cl. ..... 70/30; 70/53; 70/311; 70/312

[58] Field of Search ..... 70/18, 30, 49, 70/53, 25, 28, 306–309, 311, 312

[56] References Cited

U.S. PATENT DOCUMENTS

| | | | |
|---|---|---|---|
| 940,763 | 11/1909 | Whalen | 70/53 |
| 1,205,781 | 11/1916 | Piróg | 70/28 |
| 4,610,152 | 9/1986 | Düringer | 70/30 |
| 4,860,561 | 8/1989 | Hwang | 70/28 |
| 5,125,248 | 6/1992 | Ling | 70/312 X |
| 5,156,028 | 10/1992 | Jiang | 70/30 |

*Primary Examiner*—Lloyd A. Gall
*Attorney, Agent, or Firm*—Pro-Techtor International

[57] ABSTRACT

A combination lock comprises a lock seat, a dial set, a sliding seat, a lock tongue, a resilient block, a lock seat cover, and a shackle having a movable end and a fixed end. When the dial set is turned to a set series of numbers to work the mechanism that opens the lock, the stopping rod of the dial set is not obstructed by the dial so as to enable the fixed end of the shackle to actuate the sliding seat. The movement of the sliding seat can bring about the displacement of the lock tongue without obstructing the movable end of the shackle, thereby enabling the movable end of the shackle to be ejected by the resilient block. When the set series of numbers is disturbed, the stopping rod of the dial set remains stationary such that the sliding set is urged by the stopping rod, and that the sliding seat can not be moved by the fixed end of the shackle. The movable end of the shackle is inserted into the fastening hole of the lock seat to bring about the displacement of the lock tongue and is therefore retained securely by the lock tongue.

2 Claims, 5 Drawing Sheets

COMBINATION LOCK HAVING A SHACKLE

FIELD OF THE INVENTION

The present invention relates generally to a combination lock, and more particularly to a combination lock provided with a shackle.

BACKGROUND OF THE INVENTION

The conventional combination locks are generally limited in design in that they can be easily tampered with by an unauthorized person, and that they are not provided with a shackle capable in incapacitating an object having a considerable dimension.

SUMMARY OF THE INVENTION

It is therefore the primary objective of the present invention to provide a combination lock comprising a lock seat, a dial set, a sliding seat, a lock tongue, a resilient block, a lock seal cover, and a shackle having a movable end and a fixed end. The fixed end of the shackle is fastened securely with the sliding seat while the movable end of the shackle is retained by the lock tongue. When the dial set is turned to a set series of numbers to work the mechanism that opens the lock, the stopping rod of the dial set is not obstructed by the dial so as to enable the fixed end of the shackle to be pulled to cause the sliding seat to move. The movement of the sliding seat brings about the displacement of the lock tongue without obstructing the movable end of the shackle, thereby enabling the movable end of the shackle to be ejected by the resilient block.

When the set series of numbers is disturbed, the stopping rod of the dial set remains stationary such that the sliding seat is urged by the stopping rod, and that the sliding seat can riot be moved by the fixed end of the shackle. The movable end of the shackle is inserted into the fastening hole of the lock seat to bring about the displacement of the lock tongue and is therefore retained securely by the lock tongue.

DETAILED DESCRIPTION OF THE EMBODIMENT

Figure 1:
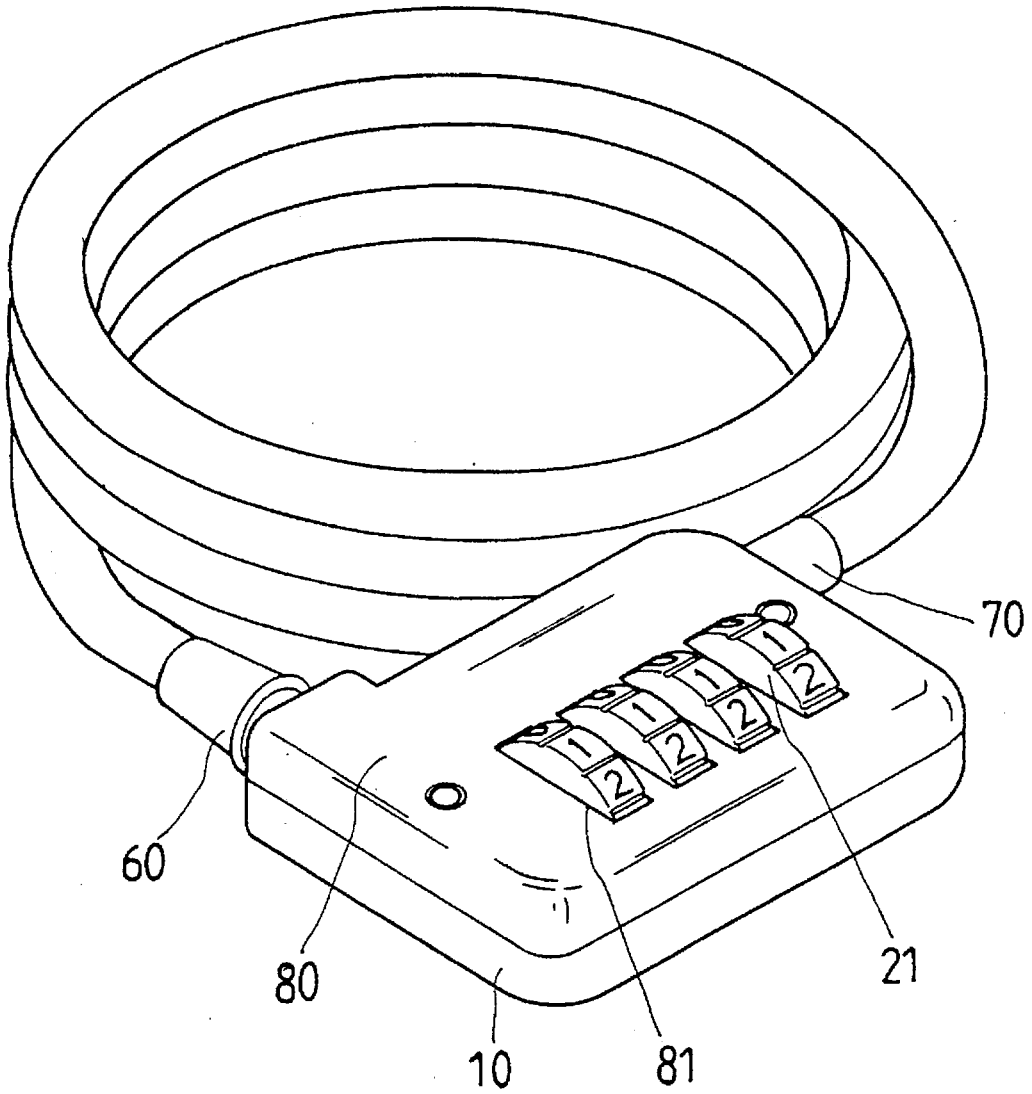
FIG. 1 shows a perspective view of the preferred embodiment of the present invention.
Figure 2:
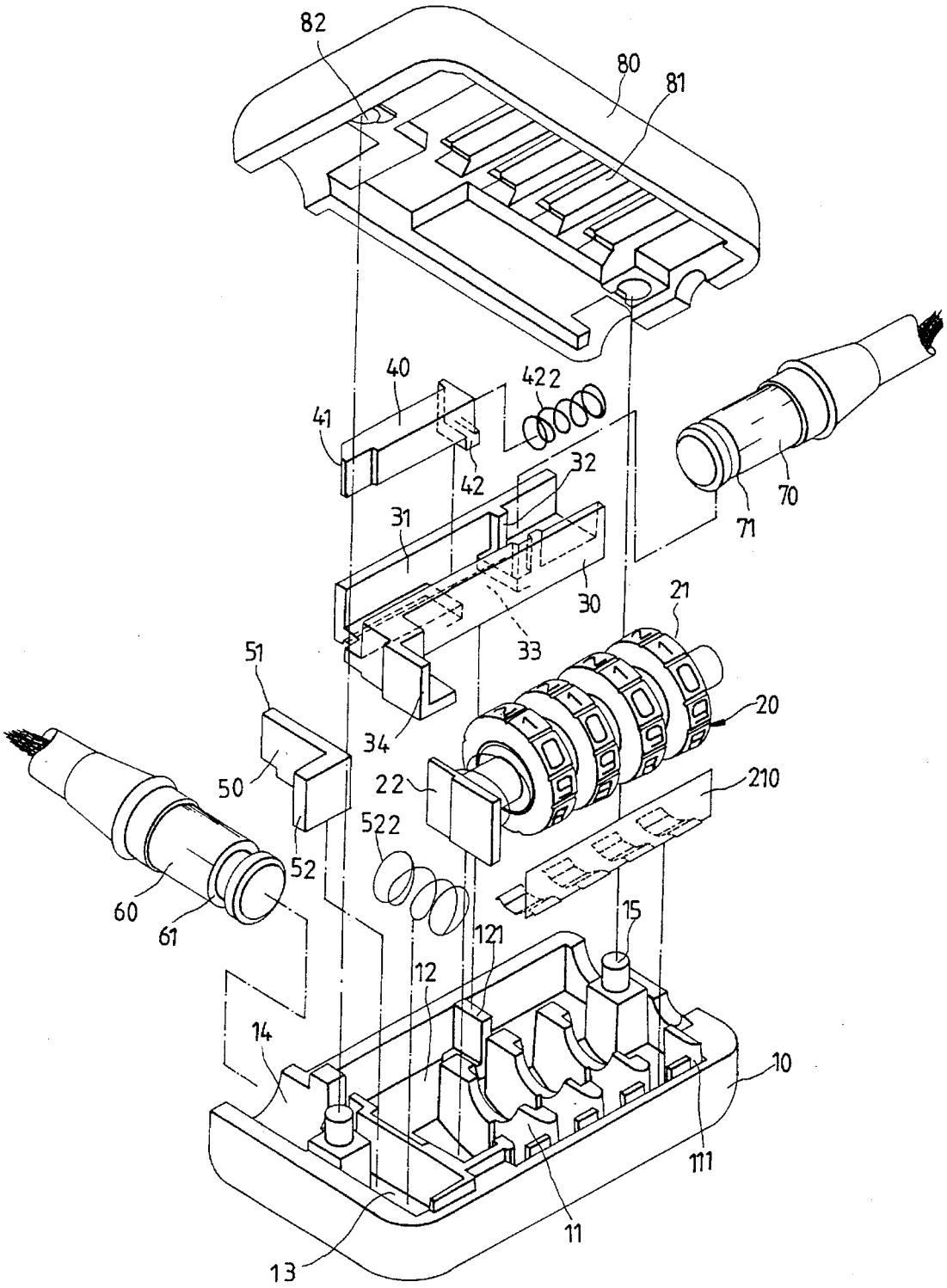
FIG. 2 shows an exploded view of the preferred embodiment of the present invention.
Figure 3:
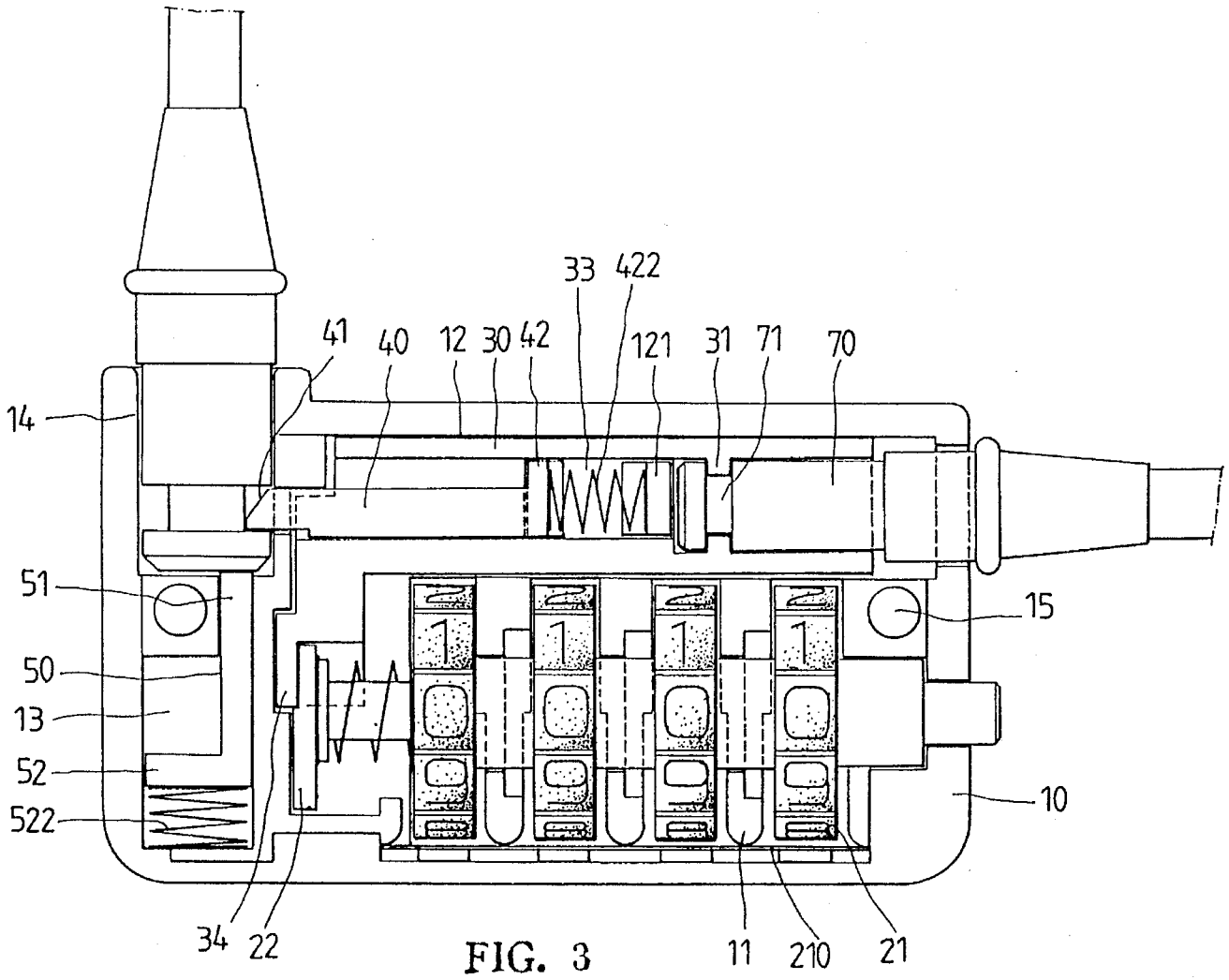
FIG. 3 shows a schematic plan view of the preferred embodiment of the present invention.

As shown in FIGS. 1 and 2, a combination lock of the preferred embodiment of the present invention comprises the component parts which are described explicitly hereinafter.

A lock seat 10 is provided therein with an action space 12, a recess 13, a fastening hole 14 and a slot 111, which are formed by a plurality of partitions 11 located in the interior of the lock seat 10. The action space 12 is provided therein with a baffle 121. The lock seat 10 is further provided respectively at both longitudinal ends thereof with a projection 15 extending uprightly.

A dial set 20 comprises a stopping rod 22 on which a plurality of numbered wheels 21 are mounted rotatably.

A sliding seat 30 is provided centrally with a receiving slot 31, which is in turn provided respectively on both longitudinal side walls thereof with a retaining rib 32 and is further provided at the bottom thereof with a window 33. Located at one longitudinal end of the sliding seat 30 is a stopping plate 34.

A lock tongue 40 is disposed in the receiving slot 31 of the sliding seat 30 and is provided at one end thereof with a bevel 41 and at another end thereof with an arresting rib 42.

A resilient block 50 comprises a long side 51 and a short side 52.

A movable end 60 of a shackle is of a hollow construction and is provided at the front end thereof with a circular neck 61 and at the rear end thereof with a sheathed steel cable.

A fixed end or a shackle is of a hollow construction and is provided at the front end thereof with a circular neck 71 and at the rear end thereof with another end of the sheathed steel cable.

A lock seat cover 80 is symmetrical with the lock seat 10 and is provided therein with a plurality of slots 81 corresponding in location to the numbered wheels 21, and with two fastening holes 82 corresponding in location to and engageable with the projections 15 of the lock seat 10.

The numbered wheels 21 of the dial set 20 are spaced equidistantly. In the process of disposing the dial set 20 in the lock seat 10, an elastic piece 210 is inserted first into the lock seat 10 via the slot 111 of the lock seat 10. The numbered wheels 21 of the dial set 20 are then disposed in the lock seat 10 such that the numbered wheels 21 are in contact with the elastic piece 210. The sliding seat 30 is disposed in the action space 12 such that the baffle 121 of the action space 12 is put through the window 33 of the sliding seat 30, and that the retaining ribs 32 are engaged with the circular neck 71 of the fixed end 70 of the steel shackle. The lock tongue 40 is received in the slot 31 of the sliding seat 30 such that the arresting rib 42 of the lock tongue 40 is retained in the window 33 of the sliding seat 30, and that the bevel 4I of the lock tongue 40 is urged by a spring 422. The resilient block 50 is disposed in the recess 13 of the lock seat 10 such that the long side 51 of the resilient block 50 is located at the bottom of the fastening hole 14, and that the short side 52 of the resilient block 50 is urged by a spring 522. The lock seat cover 80 is finally joined with the lock seat 10 such that the fastening holes 82 of the lock seat cover 80 are engaged with the projections 15 of the lock seat 10. The numbered wheels 21 are partially emerged from the lock seat cover 80 via the slots 81 of the lock seat cover 80.

Figure 4:
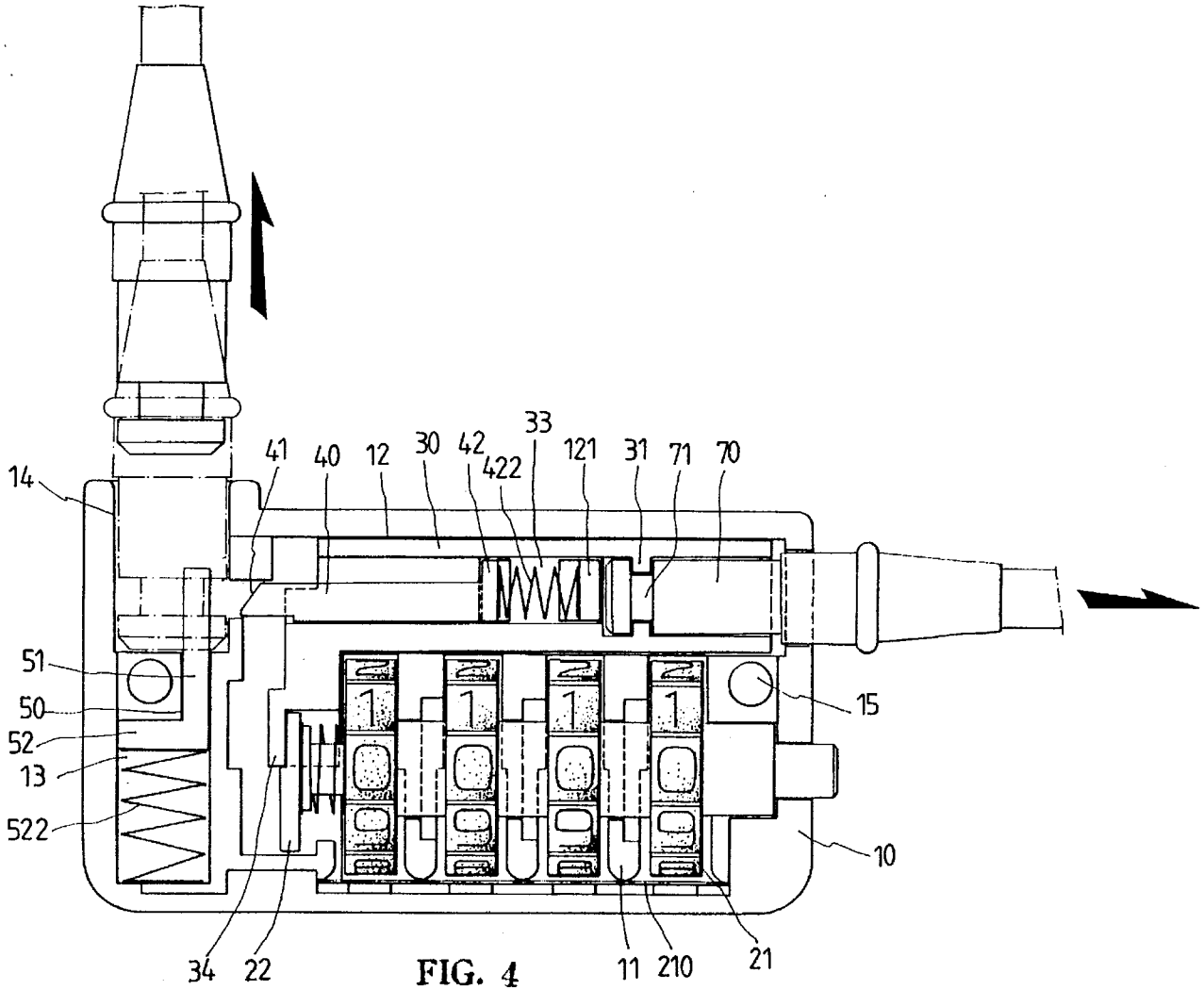
FIG. 4 shows a schematic view of the preferred embodiment at work according to the present invention.
Figure 5:
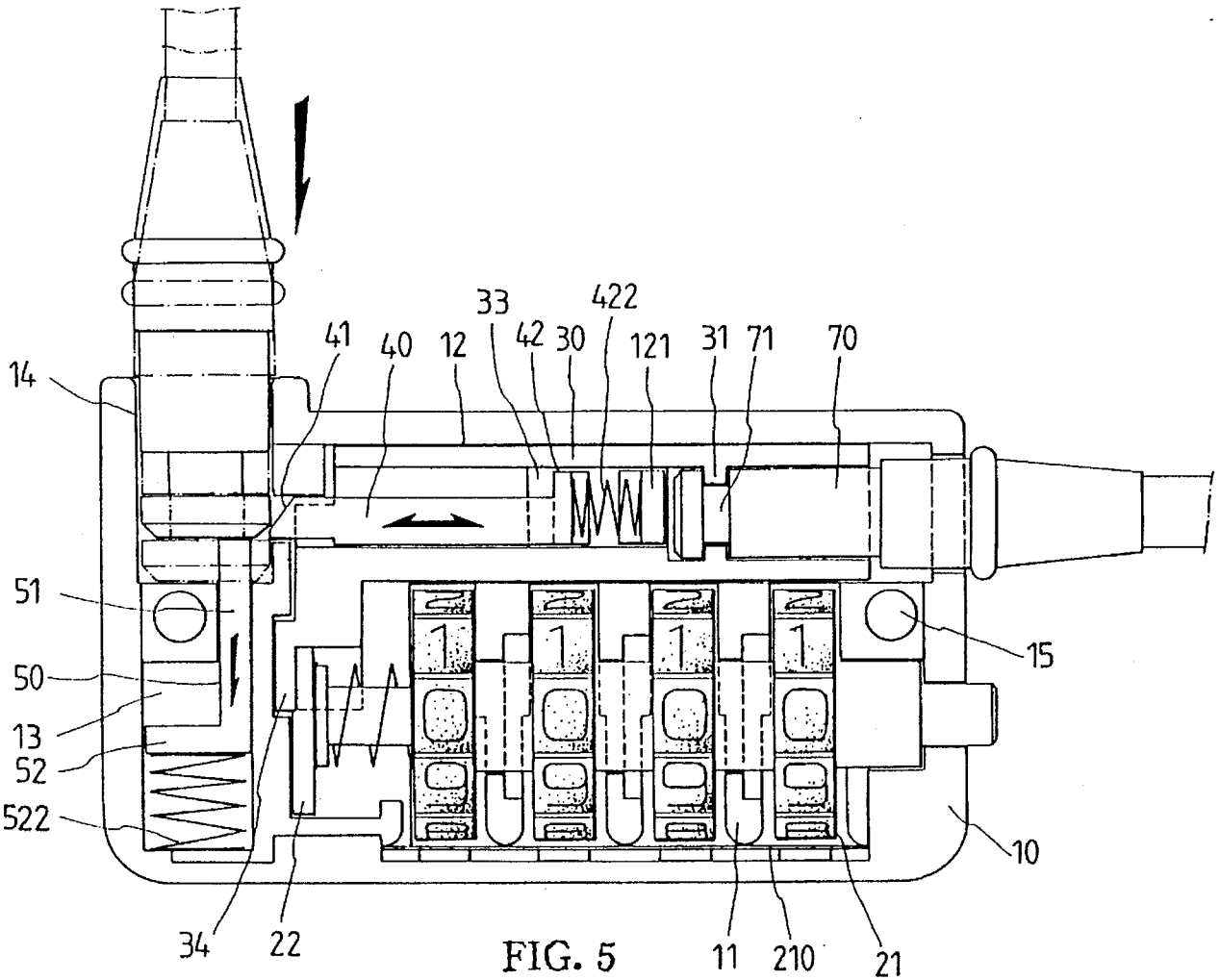
FIG. 5 shows another schematic view of the preferred embodiment at work according to the present invention.

As shown in FIGS. 4 and 5, when the numbered wheels 21 are so turned as to form a set series of numbers to work the mechanism that opens the combination lock of the present invention, the stopping plate 34 of the sliding seat 30 is not obstructed by the stopping rod 22 of the dial set 20. When the sliding seat 30 is pulled by the fixed end 70 of the steel shackle to actuate the lock tongue 40, the bevel 41 of the lock tongue 40 is disengaged from the circular neck 61 of the movable end 60 of the steel shackle, thereby enabling the movable end 60 to be ejected by the resilient block 50 via the fastening hole 14, thanks to the elastic force of the spring 522. The combination lock of the present invention is therefore in an unlocking state. The combination lock of the present invention can be put back to remain in a locking state by disturbing first the set series of numbers and then by inserting the movable end 60 of the steel cable into the fastening hole 14 of the lock seat 10. The bevel 41 of the lock tongue 40 is pushed by the inserted movable end 60 so that the spring 422 is pushed by the lock tongue 40.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A combination lock comprising a lock seat, a dial set, a sliding seat, a lock tongue, a resilient block, a shackle having a removable end and a fixed end, and a lock seat cover;

wherein said lock seat is provided therein with an action space, a slot, a baffle, a recess, a fastening hole, and two projections wherein said sliding seat is provided centrally with a slot having respectively on two side walls thereof a retaining rib, said sliding seat slot further having at a bottom thereof a window, said sliding seat further provided on one side thereof with a stopping plate, said sliding seat being connected to said fixed end for movement therewith;

wherein said lock tongue is provided at one end thereof with a bevel and at another end thereof with an arresting rib;

wherein said resilient block is provided with a long side and a short side;

wherein said lock seat cover is provided with slots corresponding in location to said dial set, and with two fastening holes engageable with said projections of said lock seat;

wherein said dial set comprises a plurality of numbered wheels and a stopping rod on which said numbered wheels are rotatably mounted;

wherein said numbered wheels can be turned to a set series of numbers to unlock said combination lock, so as to enable said fixed end to pull said sliding seat relative to said lock seat without said stopping plate being obstructed by said stopping rod, thereby displacing said lock tongue and allowing actuation of said resilient block to eject said removable end via said fastening hole of said lock seat; and wherein said set series of numbers can be so disturbed as to enable said removable end to be inserted into said fastening hole of said lock seat to actuate said lock tongue to engage said removable end securely.

2. The combination lock as defined in claim 1, wherein said stopping rod of said dial set is caused to urge said sliding seat so that said sliding seat can not be pulled by said fixed end when said set series of numbers is disturbed; and wherein said removable end is capable of urging said bevel of said lock tongue to bring about a displacement of said lock tongue.

* * * * *